US005733653A

United States Patent [19]

Cuculo et al.

[11] Patent Number: 5,733,653

[45] Date of Patent: Mar. 31, 1998

[54] ULTRA-ORIENTED CRYSTALLINE FILAMENTS AND METHOD OF MAKING SAME

[75] Inventors: John A. Cuculo; Paul A. Tucker, both of Raleigh; Ferdinand Lundberg, Garner; Jiunn-Yow Chen, Raleigh, all of N.C.; Gang Wu, Beijing, China; Gao-Yuan Chen, Apex, N.C.

[73] Assignee: North Carolina State University, Raleigh, N.C.

[21] Appl. No.: 643,925

[22] Filed: May 7, 1996

[51] Int. Cl.[6] ..... D02G 3/00

[52] U.S. Cl. ..... 428/364; 428/395

[58] Field of Search ..... 428/364, 395

[56] References Cited

U.S. PATENT DOCUMENTS

| | | | |
|---|---|---|---|
| 3,002,804 | 10/1961 | Kilian . | |
| 4,134,882 | 1/1979 | Frankfort et al. . | |
| 4,425,293 | 1/1984 | Vassilatos . | |
| 4,446,299 | 5/1984 | Koschinek et al. . | |
| 4,835,053 | 5/1989 | Stanko . | |
| 4,909,976 | 3/1990 | Cuculo et al. . | |
| 4,975,326 | 12/1990 | Buyalos et al. . | |
| 5,019,316 | 5/1991 | Ueda et al. . | |
| 5,033,523 | 7/1991 | Buyalos et al. . | |
| 5,049,447 | 9/1991 | Shindo et al. . | |
| 5,137,670 | 8/1992 | Murase et al. . | |
| 5,149,480 | 9/1992 | Cuculo et al. . | |
| 5,171,504 | 12/1992 | Cuculo et al. . | |
| 5,182,068 | 1/1993 | Richardson . | |
| 5,186,879 | 2/1993 | Simons et al. . | |
| 5,234,764 | 8/1993 | Nelson et al. . | |
| 5,268,133 | 12/1993 | Cuculo et al. . | |
| 5,405,696 | 4/1995 | Cuculo et al. . | |
| 5,486,416 | 1/1996 | Johnson et al. | 428/357 |

FOREIGN PATENT DOCUMENTS 670932 9/1963 Canada .

*Primary Examiner*—Newton Edwards

*Attorney, Agent, or Firm*—Bell Seltzer Intellectual Property Law Group of Alston & Bird

[57] ABSTRACT

Ultra-oriented, crystalline synthetic filaments with a combination of high tenacity, high dimensional stability, high modulus, and a high fraction of taut-tie molecular phase are produced by extruding a fiber-forming synthetic polymer melt into a liquid isothermal bath, withdrawing the filaments from the bath and then post-treating them at a very low draw ratio. The bath is preferably maintained at a temperature of at least 30° C. above the glass transition temperature of the polymer to enhance the orientation and promote the formation of stable extended chains. Polymer filaments so produced are characterized in that they have ultra-high birefringence, high tenacity and modulus, a high dimensional stability, and a high fraction of taut-tie molecular phase.

10 Claims, 8 Drawing Sheets

ULTRA-ORIENTED CRYSTALLINE FILAMENTS AND METHOD OF MAKING SAME

BACKGROUND OF THE INVENTION

Field of the Invention

This invention relates to a process for producing highly oriented crystalline synthetic filaments with outstanding mechanical properties, and also to the filaments thus produced. More specifically, the present invention provides a process for melt spinning and post-treating synthetic filaments having a very high degree of orientation, high modulus, high tenacity, and high dimensional stability.

Typical commercially-used melt spinning processes for the production of filaments or fibers from synthetic polymer materials are as follows: The fiber-forming polymer is melted and extruded through holes in a spinneret to form filaments which are subsequently cooled by a quenching process to solidify the filaments. Because the filaments are typically in a random amorphous state and have low crystallinity, low orientation, and inferior mechanical properties (i.e. tenacity, initial modulus, etc.), they are typically stretched or drawn in one or more steps to increase the molecular orientation and to impart the more desirable physical properties. The post-treated filaments typically have relatively high strength, but low dimensional stability, as evidenced by their high levels of thermal shrinkage. Two main parameters of dimensional stability of fibers are the LASE-5% (load at specified elongation of 5%) and thermal shrinkage at elevated temperature. Because these fibers are often used in the production of tire cord or similar products which require that the filaments be exposed to high temperatures, a low level of dimensional stability can be a problem in their subsequent use.

An example of a conventional two-step production process for commercial polyester filaments such as polyethylene terephthalate (PET) is performed as follows: The molten polymer material is extruded through a spinneret to form filaments which are solidified by quenching, usually by way of an air or a liquid bath. After solidification, the filaments are wound up. Subsequently, the as-spun filaments are subjected to drawing and annealing at a draw ratio of about 1.8–6.0. The resultant post-treated fibers typically have better mechanical properties than their as-spun counterparts, typically achieving a tenacity of 8–9 gpd, an elongation of 10–15%, and an initial modulus of 80–100 gpd. Their dimensional stability, and particularly their thermal shrinkage, tends, however, to be undesirably high. In addition, while the mechanical limits of these filaments may be acceptable for many end uses, there is much room for improvement. Further, because of the high draw ratios which must be used during post-treatment, filament breakage can occur in the drawing process.

Attempts have been made to produce high modulus, low thermal shrinkage PET yarns for use in the production of tire cord and the like. Although thermal shrinkage has been improved somewhat in some of these filaments, the strength and initial modulus have typically been sacrificed to some extent in order to achieve the lower levels of thermal shrinkage.

Processes for producing more fully oriented crystalline PET fibers in a single step with properties equivalent to or better than those produced by the conventional two-step processes have been proposed as a means of overcoming the expenses associated with two-step processing. To this end, a number of researchers have explored technology based on high speed spinning. In 1979, DuPont [R. E. Frankfort and B. H. Knox, U.S. Pat. No. 4,134,882] documented a process based on high speed spinning technology at speeds up to about 7000 m/min, providing oriented crystalline PET filaments in one step having good thermal stability and good dyeing properties. However, the fibers have mechanical properties still inferior to those of fully drawn yarns produced by the conventional two-step process.

Parallel to the above study, reports on high speed spinning research can be found elsewhere in the literature since the late 1970's. Properties and structure of high speed spun PET fibers are well characterized. Typical characteristics of high speed spun fibers are lower tenacity, lower Young's modulus and greater elongation as compared with conventional highly oriented yarns [T. Kawaguchi, in "High Speed Fiber Spinning", A. Ziabicki and H. Kawai, Eds. John Wiley & Sons, New York, 1985, p. 8]. More recently, a take-up speed of up to 12,000 m/min for spinning PET has been reported. The orientation and crystallinity of as-spun fibers, however, reach maximum values at certain critical speeds, above which severe structural defects such as high radial non-uniformity and microvoids start to develop. As a result, the prior one-step processes have not been fully satisfactory, as they fail to achieve the mechanical properties achievable by the conventional processes.

Other more successful attempts at producing high performance fibers by a one-step process are disclosed in commonly assigned U.S. Pat. Nos. 5,268,133, 5,149,480, 5,171,504, and 5,405,696, all of which are incorporated herein by reference. The processes described in the patents modify the threadline dynamics of the spinning operation to produce more fully oriented crystalline fibers in a single step operation. The process involves altering both the stress and the temperature profiles of the spinning threadline simultaneously. More specifically, the molten fiber-forming thermoplastic polymer is extruded in the form of filaments, and the filaments are directed into a liquid bath which provides simultaneously higher threadline tension and also isothermal crystallization conditions for the filaments in the bath. The filaments are withdrawn from the bath and then wound up at speeds on the order of 3000–7000 m/min.

The filaments thus produced possess high birefringences indicative of a high level of molecular orientation. The filaments are also characterized by having a high level of radial uniformity, and in particular, high radial uniformity of birefringence. As discussed in the '696 patent, the LIB as-spun filaments exhibit a unique relationship between the crystalline orientation factor ($f_c$) and the amorphous orientation factor ($f_a$), i.e $f_c/f_a \leqq 1.2$ while $f_c$ is 0.9 or above, and the percent crystallinity is less than 40. Prior to the disclosures in this patent application, the causes of this unique relationship were not understood, but currently there is evidence that the presence of a third morphological phase is responsible.

The as-spun filaments produced by the above liquid isothermal bath (LIB) spinning process are mechanically comparable to those produced by conventional two-step processes. However, the as-spun fibers still have relatively low crystallinity and do not achieve the theoretical limits for mechanical properties such as modulus, tenacity, and the like.

SUMMARY OF THE INVENTION

The present invention provides ultra-oriented, high tenacity fibers with high dimensional stability from fiber-forming thermoplastic polymers such as polyester, e.g., polyethylene terephthalate (PET).

The filaments are produced by extruding a molten fiber-forming thermoplastic polymer through a spinneret and into a liquid isothermal bath (LIB) in the manner disclosed in commonly assigned U.S. Pat. Nos. 5,268,133, 5,149,480, 5,171,504 and 5,405,696. The LIB, which is preferably maintained at a temperature of at least 30° C. above the glass transition temperature of the polymer, provides higher tension along the threadline and results in the formation of relatively high tenacity, ultra-oriented filaments. However, the filaments are less dimensionally stable than is desirable, and they fail to reach the theoretical limits of mechanical properties. Further, the low elongation at break suggests a high degree of molecular orientation and implies little proclivity for post treatment.

It has been found, however, that by drawing the LIB-spun filaments at a very low draw ratio, the physical properties are significantly improved, particularly the tenacity, the modulus, and the dimensional stability, as evidenced by a reduction in thermal shrinkage and an increased load at specified elongation. In addition, the filaments have a high fraction of taut-tie molecules, which is believed to contribute significantly to the large improvement in the various physical properties. Filaments produced according to the process of the instant invention have a unique combination of physical properties that are not achievable by conventional one and two-step. processes.

DESCRIPTION OF THE DRAWINGS

Some of the features and advantages of the invention having been stated, further features and advantages will become apparent from the detailed description which follows and from the accompanying drawings, in which.

DETAILED DESCRIPTION OF THE INVENTION

The present invention involves a process for producing polymer filaments having a combination of properties heretofore not achievable through conventional one-step or two-step melt spinning processes. As discussed above in the "Background of the invention", prior art methods for the production of high performance polymer filaments have been accomplished by way of two-step (i.e. extruding+post treatment) or one-step (extrusion+threadline modification to avoid need for post treatment) processes. The respective processes have not been fully satisfactory in that they fail to achieve theoretical mechanical properties and the desired dimensional stability; rather, the conventional processes typically require a trade-off of one property in order to achieve another.

The production process of the present invention enables the manufacture of filaments having a heretofore unachievable combination of properties, resulting in filaments which are superior to those produced by either of the previous conventional processes. The process will be discussed for purposes of example with respect to polyesters, such as polyethylene terephthalate (PET), though it is believed that the process has applicability to other crystalline polymers such as polypropylene, nylon and the like.

Figure 1:
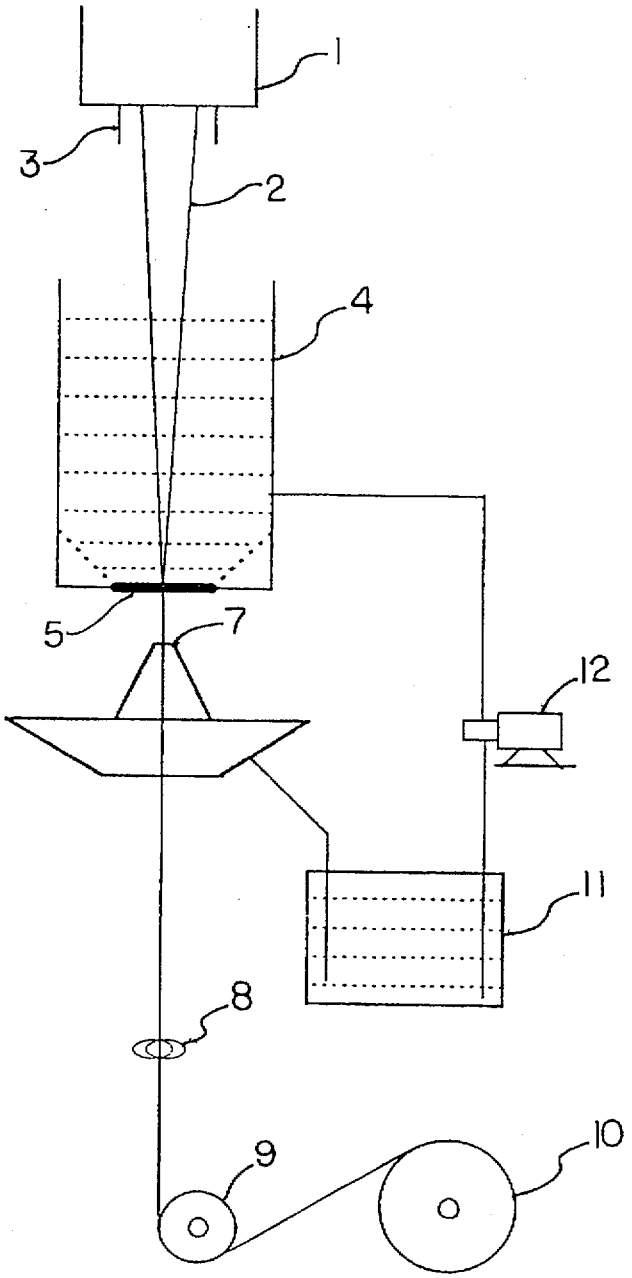
FIG. 1 is a schematic representation of an apparatus for producing as-spun filaments for practicing the process and producing the product of the instant invention.

FIG. 1 illustrates a schematic representation of an apparatus capable of producing as-spun filaments used in the process of the invention. To produce filaments according to the process of the present invention, a thermoplastic fiber-forming polymer such as PET is melted and extruded through a spinneret 1 to form filaments.

The extrudate 2 passes through a short (5 cm) sleeve 3 heated to 295° C. and is directed into a liquid isothermal bath 4 while it is still in a molten state or at least 30° C. above the glass transition temperature of the polymer. The bath temperature should be maintained at a temperature at least 30° C. above the polymer glass transition temperature ($T_g$) to ensure sufficient mobility of molecules for crystallization to proceed. Filaments in the bath undergo rapid orientation under isothermal conditions. The liquid medium in the bath not only provides an isothermal crystallization condition, which contributes to the radial uniformity of the filament structure, but also adds frictional drag, thus exerting a take-up stress on the running filaments which contributes to high molecular orientation.

The filament is then desirably pulled out through an aperture with a sliding valve 5 in the bottom of the LIB 4, passes through a closed liquid-catching device 6, through guides 7 and 8, around a godet 9, and is wound up on take-up device in the form of a package 10. Excess liquid from the LIB 4 can be gathered by the liquid-catching device 6, passed into a reservoir 11, then returned to the LIB by way of a fluid circulating device 12.

The level of take-up stress on the threadline depends on several factors such as liquid temperature, viscosity, depth and relative velocity between filaments and liquid medium. The liquid isothermal bath has a depth which is selected according to the properties of the filaments being spun, but is typically up to about 50 centimeters deep. In accordance with the present invention, the take-up stress is desirably maintained within the range of 0.6 to 6 g/d (grams per denier), and most desirably within the range of 1–5 g/d. When the filaments are withdrawn from the bath, they are preferably wound up at speeds on the order of 3000–7000 meters per minute.

Figure 2:
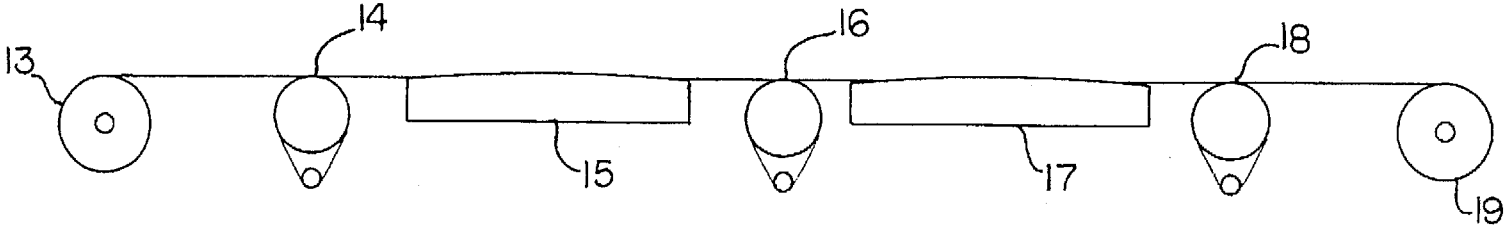
FIG. 2 is a schematic representation of an apparatus treating as-spun filaments according to the instant invention.

The filaments are desirably then drawn and annealed at an imposed draw ratio of no more than about 1.5. This can be performed by conventional methods, such as by passing the fibers over one or more heaters between two or more rollers. FIG. 2 shows an example of the drawing and annealing process, with the filaments being removed from package 13, running through rolls 14, 16, 18, between which heaters 15, 17 are positioned for heating the fibers. The post-treated filaments can then be wound on a package 19 or the like. Though FIG. 2 illustrates post-treatment of the fibers being performed in a separate operation from the spinning of the fibers, it is noted that post-treatment of the fibers can occur in-line with the spinning operation, within the scope of the instant invention. The draw ratio used is considerably lower than the draw ratios used for post-treatment of conventional fibers, which normally range from about 1.8–6.0 or greater. In a preferred form of the invention, the filaments are drawn and annealed at about 160°–250° C. at a draw ratio of no more than about 1.5, and desirably at a draw ratio of no more than about 1.3.

The mechanical properties achieved as a result of the threadline modification and post treatment are surprising, particularly with such a low draw ratio. As discussed previously, conventional fibers have desirably high tenacities, but an accompanying high thermal shrinkage. In contrast, fibers produced according to the present invention have extremely high tenacities and other mechanical properties, especially a higher than previously produced LASE-5% value (i.e. load at a specified elongation of 5%) and a desirably low thermal shrinkage. For purposes of the present invention, thermal shrinkage may be measured by exposing the fibers to hot air at about 177° C. using ASTM D885 test procedure as a general guide. In a preferred form of the invention, the thermal shrinkage of the fibers is about 10% or less when exposed to hot air at 177° C. using ASTM test procedure D885 as a general guide. The marked increase in filament properties is particularly surprising because the as-spun LIB filaments have a relatively low elongation at break. The relatively low elongation typically would suggest a high level of orientation, thus implying that the filaments would not benefit from further post-treatment. Further, for typical post-treatment processes to be effective, the draw ratios must be relatively high. Thus the efficacy of the low draw ratios in imparting the dramatic increase in fiber properties is unexpected.

In addition, filaments according to the instant invention typically have ultra-high birefringence, tenacity, modulus, and load at specified elongation, as will be illustrated herein in the following Examples. In a preferred form of the invention, the filaments desirably have a LASE-5% value of about 4 grams per denier or greater, a birefringence of about 0.2 or greater, a tenacity of about 9 grams per denier or greater, and a modulus of about 100 grams per denier.

As an explanation for the dramatic increase in fiber properties from such a modest post-treatment process, the inventors believe the superior fiber properties to be a function of the large amount of taut-tie molecules present in the fibers produced according to the present invention. The taut-tie molecules resemble crystalline molecules in that they are more highly oriented than their amorphous counterparts. The large number of taut-tie molecules present in the filaments of the invention are believed to be a result of the unique combination of LIB spinning and moderate post-treatment. Thermoplastic polymer filaments produced according to the instant invention desirably have at least about 10%, and preferably at least about 13.5%, taut-tie molecules. Because the taut-tie molecules require exposure to greater temperatures to relax than their amorphous counterparts, the filaments of the present invention can withstand exposure to greater temperatures than the conventional filaments, while maintaining their original dimension, to thereby attain lower thermal shrinkage. This higher dimensional stability, as evidenced by the high LASE-5% values and low thermal shrinkage, is particularly desirable because many of these fibers have high-performance end uses, such as in tire cord manufacture, where strength, modulus and dimensional stability are critical.

EXAMPLES

Characterization Methods (a)-Birefringence- Birefringence was measured using a Leitz 20-order tilting compensator mounted in a Nikon polarizing microscope. Instructions per the compensator's user's manual were followed. (Ernst Leitz Wetzler GmbH, *Manual of Instructions and Tables,* No. 550-058, for the Leitz Tilting Compensator, E. Wetzler, Germany, 1980.) The average birefringence was based on five individual fiber samples. The volume fraction crystallinity was calculated from density values measured in a sodium bromide density gradient column.

(b)-Tensile Testing- An Instron tester model 1122 was used to measure tenacity, ultimate elongation, initial modulus, and load at specified elongation of 5% (LASE-5%) according to ASTM D3822-90. Single fiber samples were tested at a gauge length of 25.4 mm and a constant crosshead speed of 20 mm/min. An average from at least five individual tensile tests was obtained for each sample. This Instron tensile tester was also used for hysteresis measurements. The fiber samples of original 25.4 mm length were cyclically stretched to 5.0% extension. In order to obtain reliable initial moduli, a large magnification was applied to the extension axis. The crosshead speed was chosen to be 5 mm/min, and the chart speed was chosen to be 500 mm/min, LASE-5% (load at specified elongation of 5%) was obtained from the first stress-strain curve of the cycling series. The cycling was repeated 50 times. The stress-strain curves of the 1st and 50th extension cycles were recorded. From these hysteresis curves, permanent strains were calculated. Permanent strain was calculated by dividing the residual strain present in each of the 50th run extension curves by the imposed strain of 5%.

(c)-Boil-off Shrinkage (BOS) and Thermal Shrinkage- Boil-off shrinkage was determined by immersing fiber samples in boiling water for 5 minutes in accordance to ASTM D2102-79. Thermal shrinkage was measured in a hot air oven at 177° C. using the ASTM D885 procedure as a general guide. The percent shrinkage was calculated using the following equation:

$$\text{Shrinkage (\%)} = \frac{1_o - 1}{1_o} \times 100$$

where $1_o$ is the initial fiber length and 1 is the fiber length after treatment.

(d)-Density and Crystallinity- Density measurements were run in accordance with ASTM D1505-68. The density column contained sodium bromide solution (NaBr). The relative volume fraction crystallinity ($X_v$) was calculated as $$X_v = \frac{P - P_a}{P_c - P_a}$$

where P is the measured fiber density, $P_a$ is the density of the amorphous phase, and $P_c$ is the density of crystalline phase. The values of $P_a$ and $P_c$ are 1.335 g/cm$^3$ and 1.455 g/cm$^3$, respectively (L. E. Alexander; "*X-Ray Diffraction Methods in Polymer Science,*" 191, reprint ed., Krieger (1985)).

(e)-Fiber denier- Fiber denier was determined by the vibroscope method in accordance with ASTM D1577. The linear density of the sample was calculated based on the following equation:

linear density (in units of g/m)=$t/(4L^2f^2)$ where t is the pretension applied on the fiber, L is the effective fiber length, and f is the fundamental resonant frequency.

Example 1

Polyethylene terephthalate (PET) chips having an intrinsic viscosity (IV) of 0.97 dL/g and viscosity molecular weight My of ca. 29,400 were used. Before extrusion, the PET chips were dried in a vacuum oven at 140° C. for at least 16 hours. The spinning temperature was set at 298° C. A conventional spinneret with an 0.6 mm diameter orifice was used, and a 5 cm heated sleeve set at 295° C. was mounted beneath the spinneret to maintain a uniform surface temperature. Unless otherwise specified, the as-spun denier per filament was set at 4.5. The experimental samples were produced using the LIB spinning method, while the control (i.e. unperturbed) filaments were produced using a traditional spinning process method comprising extrusion, quenching, take-up and post-treatment.

In the liquid isothermal bath (LIB) process, the liquid bath was positioned such that the bottom of the bath was 100 cm from the spinneret. The liquid medium of 1,2-propanediol was heated to 175° C., and the take-up speeds were set in the range of 2000–5000 m/min. The depth of liquid bath was kept at 45 cm for the 2000–4000 m/min take-up speed, and at 30 cm for the 4000–5000 m/min take-up speed. At 5000 m/min, the liquid bath was kept at depths of 20, 25, and 30 cm.

A liquid collector was placed below the liquid isothermal bath to collect and recycle the heated liquid, and to allow the threadline to fall vertically downward without any direction change. Downstream, the spinline was cooled by ambient air at 23° C. and taken up by high-speed godet rollers. In the unperturbed process, the threadline was quenched with ambient air only.

Some of the as-spun fibers were then selected and subjected to a continuous post-treatment process consisting of drawing at 180° C. and annealing at 220° C. The as-spun fibers were drawn to a near maximum draw ratio in the drawing step and to a minimal draw ratio in the annealing step to retain threadline stress and to minimize shrinkage. As illustrated in Table 1, the draw ratios used for this Example were 1.1 and 1.2.

The results of this example are illustrated in Table 1.

As illustrated, the post-treated LIB-spun fibers have higher initial modulus, higher strength, and higher load at specified elongation-5% (LASE-5%) values. For example, the LASE-5% values for the post-treated LIB-spun fibers range from 5.48–5.78 gpd, as compared with 2.94–3.31 for the commercial fibers. In addition, the post-treated LIB-spun fibers have superior lower thermal shrinkage than the conventional low shrinkage fibers. LASE-5% and thermal shrinkage are considered to be two main parameters of dimensional stability; thus, the fibers of the present invention have greater dimensional stability than the conventional ones.

The LIB-spun filaments typically have the unique structural properties of high non-crystalline orientation, low crystallinity, and relatively high strength and initial modulus. The LIB-spun filaments also tend to have a higher birefringence than those produced by the conventional spinning methods. For example, traditional as-spun PET filaments have a birefringence of about 0.07–0.10, which is typically increased to about 0.19–0.20 as a result of post-treatment. In comparison, PET filaments produced by the LIB spinning method typically have an as-spun birefringence of about 0.17–0.21.

Figure 3:
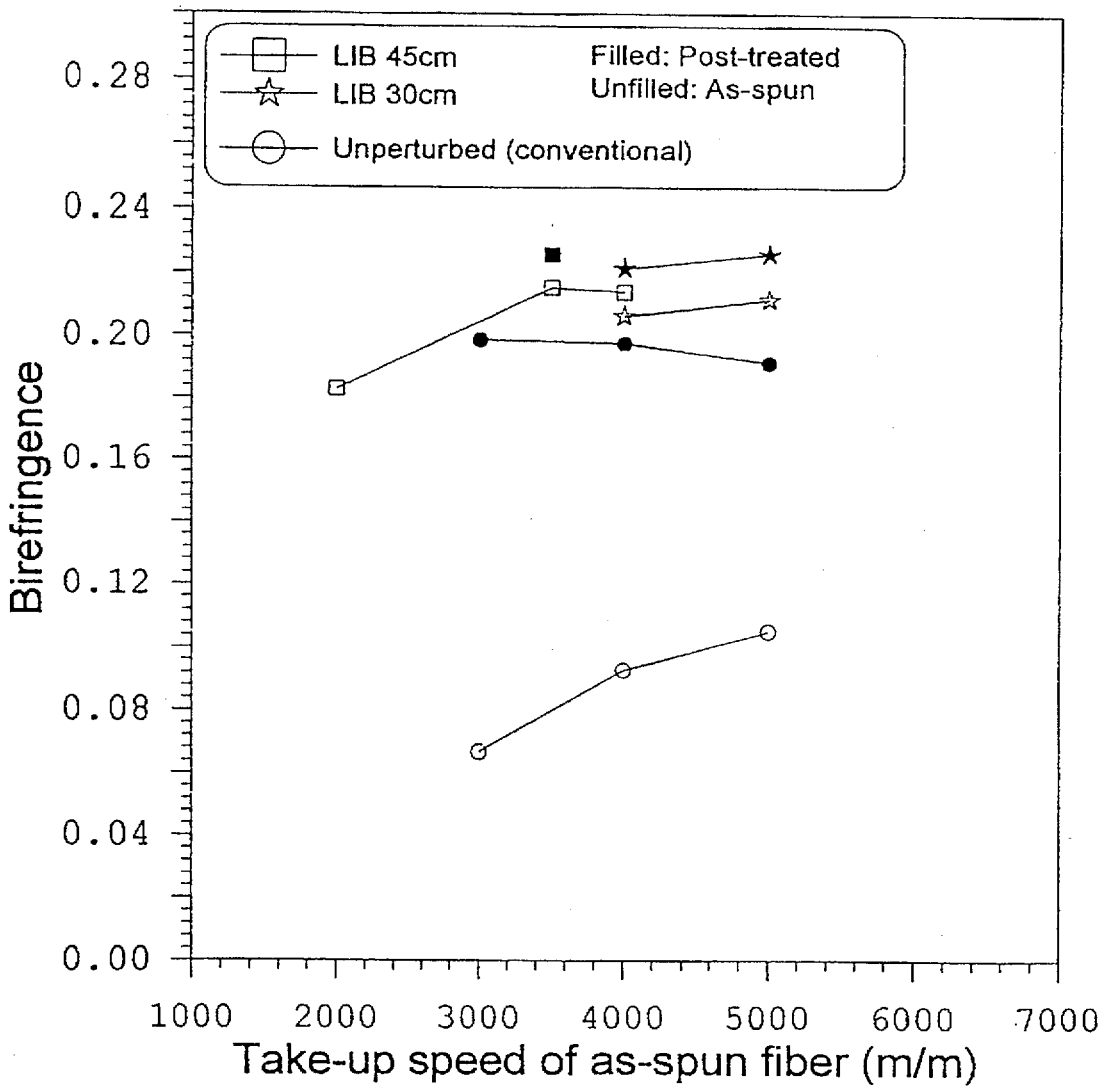
FIG. 3 is a graphic illustration of the relationship of birefringence vs. take-up speed of as-spun conventional and LIB-spun fibers before and after post-treatment.
Figure 4:
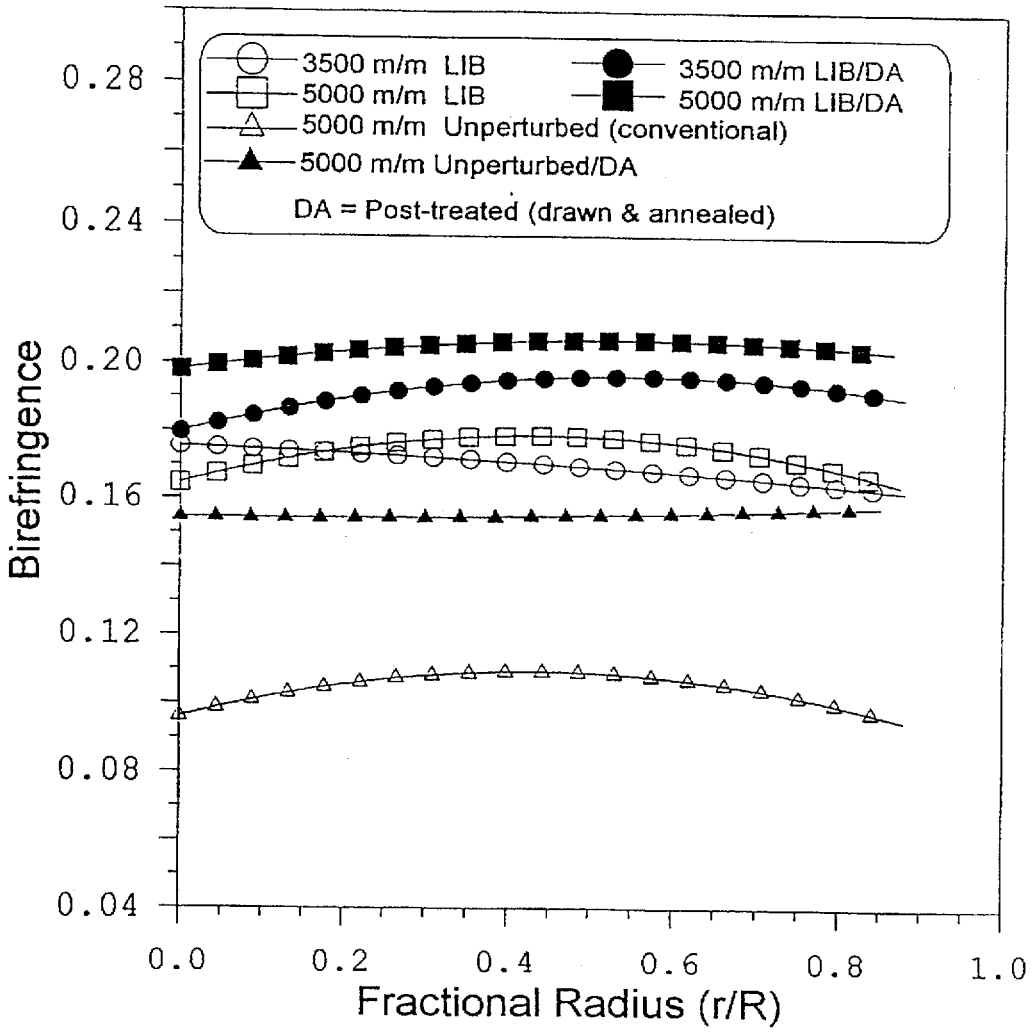
FIG. 4 is a graphic illustration of birefringence vs. fractional radius for conventional and LIB-spun filaments before and after post-treatment.

As discussed previously, the filaments produced by conventional methods require a high draw ratio, typically on the order of 1.8–6.0, in order to produce the increase in birefringence. Surprisingly, it has been found that the birefringence of the LIB as-spun filaments can be increased to levels previously not achievable by a single drawing step, and surprisingly, the high birefringence can be achieved using only a very low draw ratio. The significant differences between the birefringence of conventional filaments and those of the present invention are illustrated in FIG. 3. Further, as illustrated in FIG. 4, the post-treated fibers of the invention maintain their radial uniformity during the post-treatment process. This is an important feature, because high radial non-uniformity and microvoids, as occasioned in the traditional high speed spinning process, are considered to be severe structural defects which can render the fibers unacceptable for their intended use. For example, PET filaments have had their birefringence increased from the as-spun LIB levels of 0.17–0.21 to 0.22–0.23 using a draw ratio of no more than about 1.3, and even at a draw ratio of no more than about 1.2.

The low draw ratios necessary to provide the superior mechanical properties and excellent dimensional stability achieved by the filaments of the instant invention are surprising for additional reasons. In traditional high-speed spinning, a fiber with low crystallinity, all other things being equal, generally has a higher extensibility than that of a fiber with high crystallinity. Therefore, one would expect that the LIB as-spun filaments would require a higher draw ratio than filaments produced by conventional methods, since the LIB as-spun filaments typically have a lower crystallinity than those conventionally spun at high speeds.

It is believed by the inventors that the LIB spinning results in a third morphological phase which causes the unexpected results of post-treatment. The third phase, i.e. the taut-tie molecular phase, is essentially an intermediate phase between the traditionally termed "crystalline" and "amorphous" morphological phases. It is believed that these taut-tie molecules are extended, aligned and relatively ordered as compared with the conventionally-termed "amorphous" phase molecules, but are not ordered to the extent of the crystalline molecules.

Further evidencing the existence of taut-tie molecules is the comparison of boil-off shrinkages of the conventional as-spun and LIB as-spun filaments. In conventional high-speed spinning, as crystallinity increases, boil-off shrinkage decreases. (G. Vassilatos, G. H. Knox and H. R. E. Frankfort, "*High-Speed Fiber Spinning,*" *Chap.* 14, Ed. by A. Ziabicki and H. Kawai, Wiley-Interscience (1976)). In contrast, in the case of the LIB as-spun filaments, boil-off shrinkage decreases along with decreasing crystallinity. This supports the presence of a taut-tie molecular phase.

The amount of taut-tie molecules (TTM%) can be calculated using the following equation:

(TTM%) is calculated on the basis of a parallel-series three-phase model with the assumption that the modulus of the taut-tie molecular phase is equal to that of the crystalline phase, and calculated by the following equation (M. Kamezawa, K. Yamada, and M. Takayanagi, *J. Appl. Polym. Sci.*, 24, 1227 (1979)):

$$TTM\,\% = \frac{V_a E(E_c - E_a) - E_a(E_c - E)}{V_a E_c(E_c - E_a) - E_a(E_c - E)}$$

where, $V_a$=1–$X_v$ and the $X_v$ is from the equation listed above, in part (d) "Density and Crystallinity", E is initial modulus in units of gpd, $E_c$ is crystal modulus (=110 Gpa) (C. L. Choy, M. Ito, and R. S. Porter, *J. Polym. Sci., Polym.*

*Phys.*, 21, 1427 (1983), T. Thistlethwaite, R. Jakeways, and I. M. Ward, "*Polymer*", 29, 61 (1988)) and $E_a$ is amorphous modulus (=2.1 Gpa) (Choy, et al.), and the Gpa unit is converted to gpd units by applying the equation (H. H. Yang, "Kevlar Aramid Fiber," 187, Wiley (1992)):

$$[gpd]=[Gpa]x11.33/P,$$

and P=measured fiber density.

Table 2 shows the effect of LIB depth on the fractional amounts of the taut-tie molecular phase, initial modulus, and crystallinity ($X_v$) in the as-spun LIB fibers, which were spun at take-up speed of 5000 m/min. Values for an unperturbed (without LIB) as-spun fiber are also included for comparison.

TABLE 2

Effect of LIB Depth on Fraction of Taut-Tie Molecular Phase, Initial Modulus and Crystallinity

| LIB depth (cm) | Fraction of taut-tie molecular phase (%) | Initial modulus (gpd) | $X_v$ (%) |
|---|---|---|---|
| 20 | 10.69 | 117.2 | 32.3 |
| 25 | 12.21 | 129.7 | 27.7 |
| 30 | 13.31 | 139.4 | 29.1 |
| w/o LIB | 4.06 | 62.5 | 39.5 |

Figure 5:
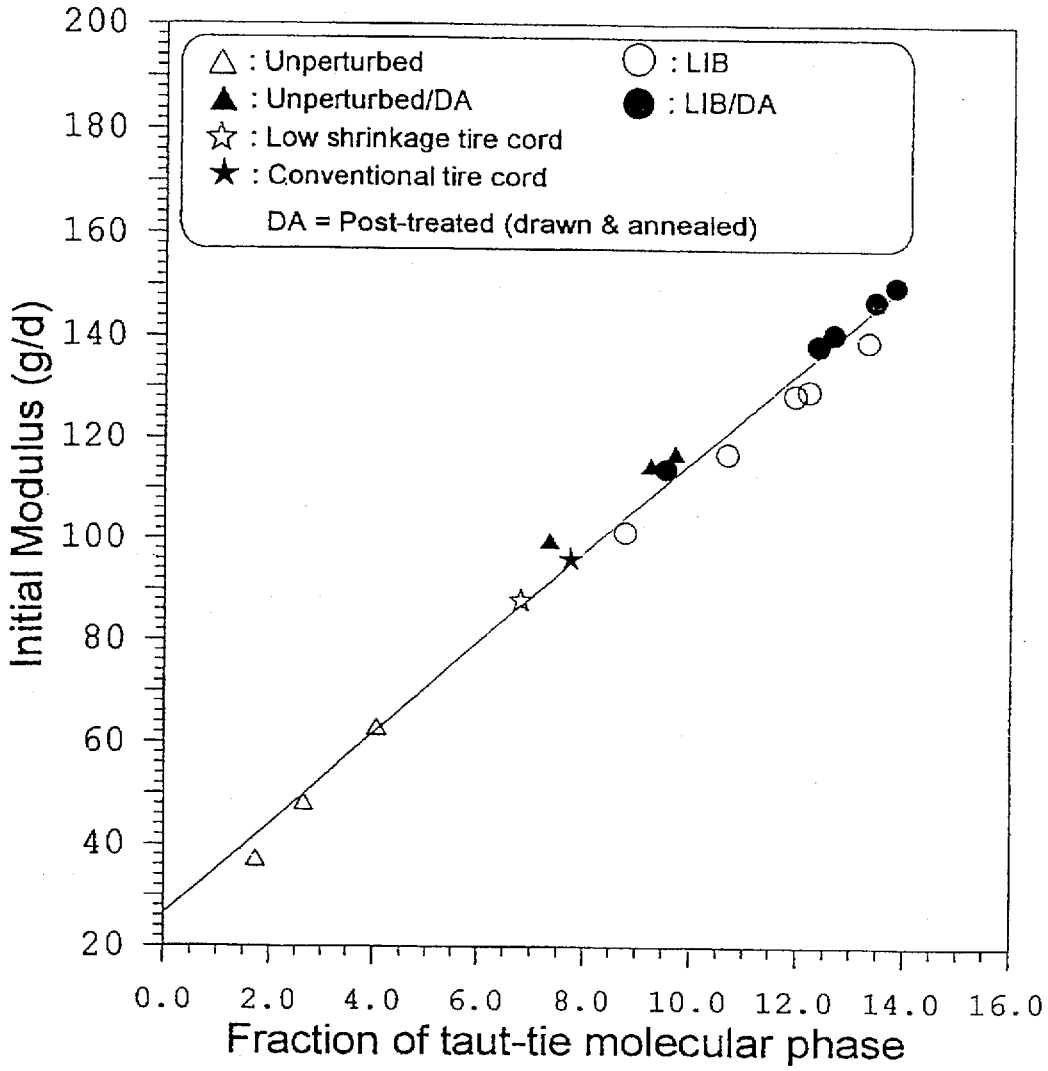
FIG. 5 is a graphic illustration of initial modulus vs. fraction of taut-tie molecular phase for the various fibers sampled.

FIG. 5 illustrates the fractions of taut-tie molecular phase of the post-treated LIB-spun fibers as they compare with the fractions contained in conventional fibers. As the graph illustrates, the fraction of taut-tie molecular phase is much greater in the post-treated LIB-spun filaments than in the conventional fibers.

Example 2

Two types of PET chips with intrinsic viscosities of 0.97 dL/g and 0.60 dL/g, as measured in a 60/40 wt % phenol/tetrachloroethane solvent at 25° C., were utilized in this example. Sample designations and the preparation conditions are listed in Table 3 below. Samples A and C are as-spun filaments produced using the liquid isothermal bath (LIB) spinning process, with low and high molecular weight chips, respectively. The LIB spinning process was the same as that described above.

Sample A was produced at a take-up velocity of 5000 m/min, with the bottom of the bath located 100 cm from the spinneret, and the liquid depth and temperature were fixed at 20 cm and 150° C., respectively. Sample C was produced at a take-up velocity of 4500 m/min, with the bottom of the bath located 180 cm from the spinneret and the liquid depth and temperature fixed at 30 cm and 160° C., respectively. Both of these as-spun filaments (A and C) were subsequently drawn at 180° C. and annealed at 200° C. with an imposed draw ratio of 1.16–1.17. As shown in Table 3, the drawn and annealed filament produced from sample A was designated as sample B, and the drawn and annealed filament produced from sample C was designated as sample D. Two commercial PET yarn samples (E and F) produced through traditional two-step processes are also listed in Table 3. While the details regarding the production of these commercial samples are not available, a clearly distinguishable feature is observed when the mechanical properties and shrinkage characteristics of these two samples are compared.

As shown in Table 4, the conventional yarn has a high tenacity, but also has a characteristically, and undesirable, high shrinkage. The HMLS (high modulus/low shrinkage) tire yarn has a relatively low shrinkage, but also has an undesirably low tenacity. These two samples were obtained as multifilament yarns and then separated into single filaments for comparative study.

Figure 6:
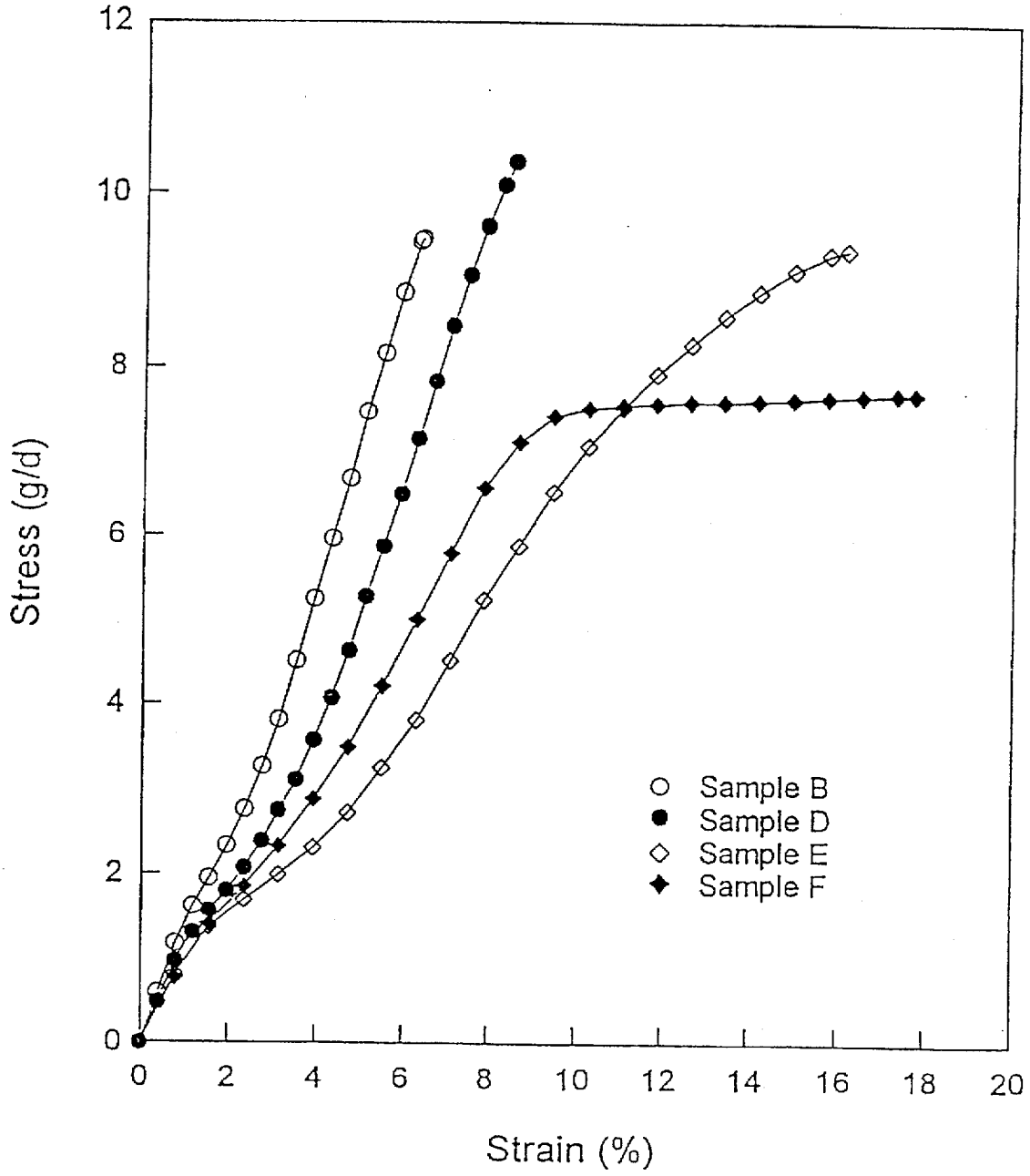
FIG. 6 is a graphic illustration of stress vs. strain for samples B, D, E and F of Example 2.
Figure 7:
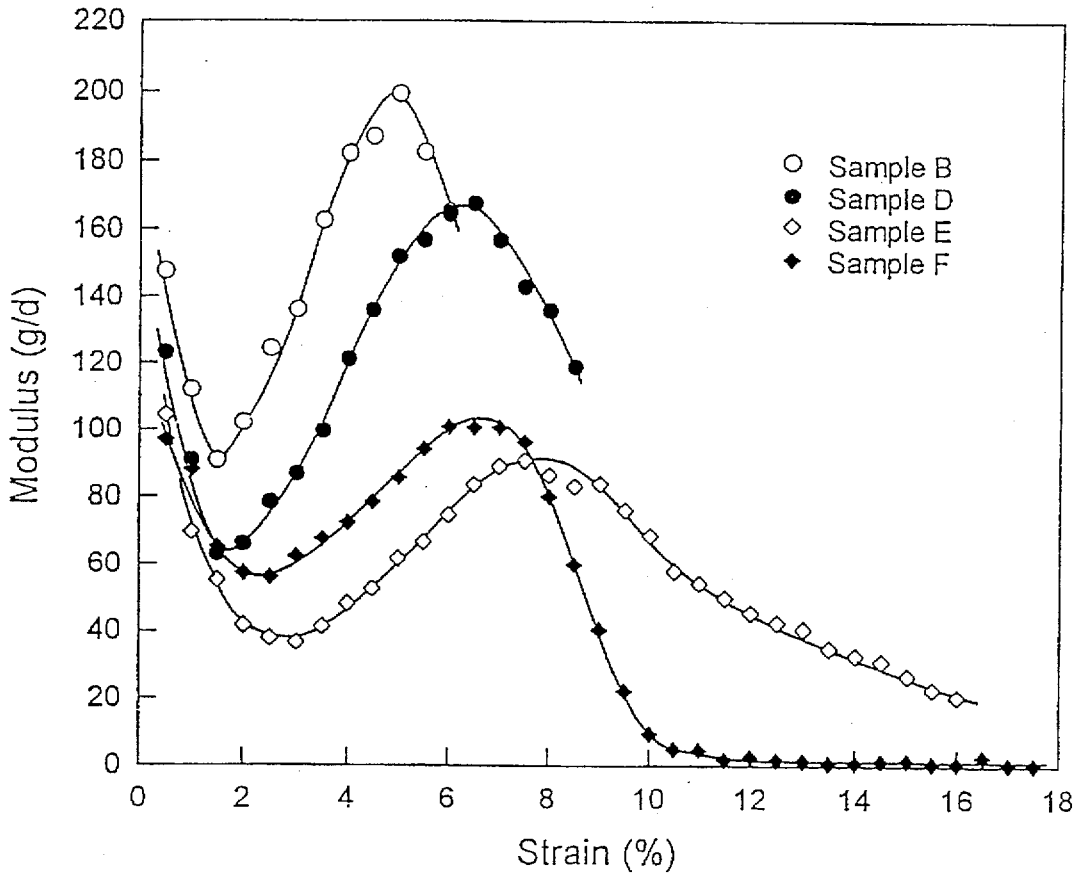
FIG. 7 is a graphic illustration of modulus vs. strain for Samples B, D, E and F of Example 2.
Figure 8:
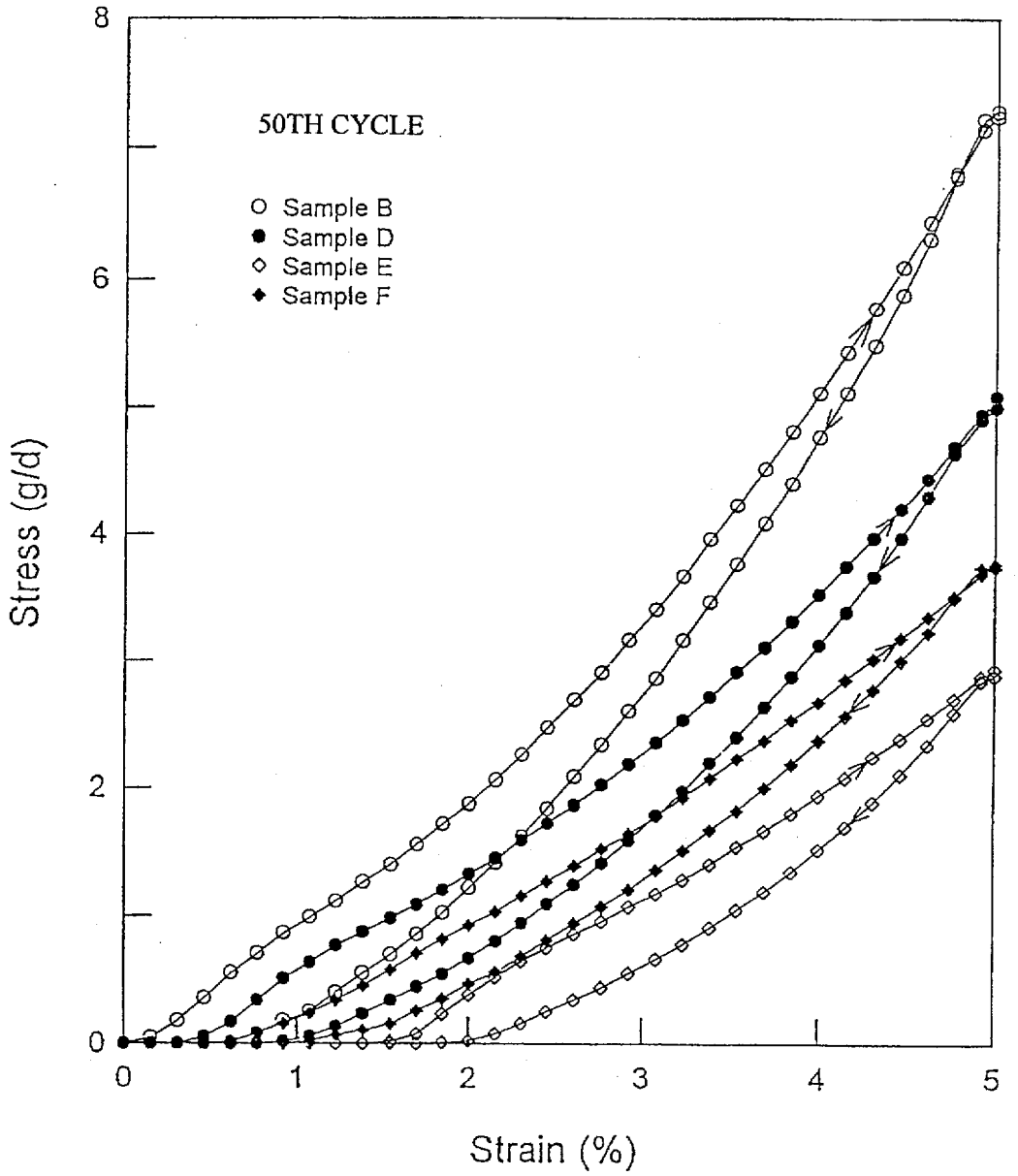
FIG. 8 is a graphic illustration of stress v. strain on the 50th load-unload cycle of 0 to 5 percent strains.

The results of the sample tests are outlined in Tables 4 and 5 and FIGS. 6–8.

TABLE 5

Structural Analysis of Fibers Produced in Example 2

| Sample | Crystallinity Xv (%) | Birefringence Δn | crystalline orientation factor $f_c$ | amorphous orientation $f_a$ |
|---|---|---|---|---|
| A | 20.0 | 0.222 | 0.936 | 0.822 |
| B | 53.8 | 0.235 | 0.979 | 0.938 |
| C | 15.2 | 0.214 | 0.940 | 0.783 |
| D | 50.2 | 0.237 | 0.973 | 0.946 |
| E | 48.6 | 0.215 | 0.969 | 0.788 |
| F | 47.5 | 0.202 | 0.951 | 0.713 |

As illustrated, tenacity and modulus were increased from their LIB as-spun levels to levels significantly higher than those achieved by the commercial fibers. Further, the shrinkage was significantly reduced from the as-spun levels. In addition, the LASE-5% values are higher than those achieved by the commercial samples. Thus, the results illustrate that the filaments of the present invention not only have superior mechanical properties to conventional fibers, but they have superior dimensional stability.

Further, the birefringence was increased as a result of the post-treatment, reaching levels significantly higher than those previously achieved by conventional fibers.

As shown in FIG. 7, despite the relatively high initital modulus (i.e. the modulus at the instant in time where the fiber is at 0.5% elongation) the maximum modulus achieved after the yield point (i.e. the minimum modulus reached) is significantly higher than the initial modulus. Preferably, the maximum modulus achieved after the yield point is at least about 10 g/d, and more preferably about 20 g/d, higher than the initial modulus. As illustrated on the graph, the yield point is indicated by the lowermost point of the first dip in the modulus, and the maximum modulus is indicated by the peak of the upward curve following the yield point, which is in turn followed by a succeeding decline in the modulus. Further, the terminal modulus (as indicated by the last point on the modulus vs. strain curve in FIG. 7) is significantly higher for the LIB spun, post-treated fibers than for the conventional fibers. Preferably, the terminal modulus for the fibers is about 35 gpd or greater, and more preferably about 50 gpd or greater.

As illustrated in FIG. 8, the filaments of the present invention had an elongation of less than about 3.4% at 2.25 gpd stress on the loading stress-strain curve of the 50th cycle of the filament undergoing load-unload cycles between 0–5 percent strains.

The present invention is not limited by the specific examples given above. The embodiments of the invention also apply to fiber spinning of synthetic polymers other than those specifically illustrated above. This is based on morphology development simultaneously under high tension and under isothermal crystallization conditions to promote stable extended chains. Other polymers, such as polypropylene, nylon and others are suitable.

TABLE 1

Properties of Fibers Produced in Example 1

| | Tenacity (gpd) | Elongation (%) | Modulus (gpd) | LASE-5% (gpd) | BOS (%) | Thermal Shrinkage (%) |
|---|---|---|---|---|---|---|
| As-spun LIB1 | 8.3 | 14.8 | 128.8 | 3.64 | 11.5 | 15.6 |
| LIB1/DA*: DR = 1.1 | 9.1 | 10.7 | 138.9 | 5.49 | — | — |
| LIB1/DA*: DR = 1.2 | 10.0 | 9.8 | 147.5 | 5.78 | — | 5.0 |
| As-spun LIB2 | 9.6 | 10.5 | 139.4 | 5.07 | 10.0 | 15.2 |
| LIB2/DA*: DR = 1.1 | 10.3 | 8.7 | 140.9 | 5.48 | — | 4.9 |
| Unperturbed | 4.1 | 67.5 | 62.5 | 1.23 | 3.0 | 3.5 |
| Unperturbed* DA, DR = 1.5 | 5.7 | 16.1 | 116.8 | 3.13 | — | 3.3 |
| Commercial 1 | 9.5 | 16.6 | 96.1 | 2.94 | — | 13.75 |
| Commercial 2 | 7.4 | 16.5 | 87.9 | 3.31 | — | 6 |

DA = Drawn and annealed, DR = Draw ratio, BOS = Boil-off shrinkage,
LIB 1 = Take-up speed of 3500 m/min, spinning denier 6 dpf (denier per filament), LIB depth 45 cm,
LIB 2 = Take-up speed of 5000 m/min, spinning denier 4.5 dpf, LIB depth 30 cm,
Unperturbed = Conventional spinning process, take-up speed 5000 m/min, spinning denier 4.5 dpf,
Commercial 1 = Conventional commercial tire cord,
Commercial 2 = Low shrinkage tire cord.
*Post Treated

TABLE 3

Preparation Conditions for Fiber Samples Produced in Example 2

| | | Spinning | | Post Treatment | | | |
|---|---|---|---|---|---|---|---|
| | | Take-up Velocity | LIB Temp. | Temp. (°C.) | | Draw | |
| Sample | Remarks | (m/min) | (°C.) | Draw | Ann. | Ratio | Denier |
| A | LIB as-spun fiber (low IV) | 5000 | 150 | — | — | — | 5.06 |
| B | LIB/DA* from A | — | — | 180 | 200 | 1.17 | 4.34 |
| C | LIB as-spun fiber (high IV) | 4500 | 160 | — | — | — | 4.93 |
| D | LIB/DA* from C | — | — | 180 | 200 | 1.16 | 4.24 |
| E | Conventional tire yarn | — | — | — | — | — | 5.34 |
| F | HMLS tire yarn | — | — | — | — | — | 2.77 |

(Note: IV = intrinsic viscosity)
*Post Treated

TABLE 4

Mechanical Properties of Fibers Produced in Example 2*

| Sample | Tenacity (g/d) | Modulus (g/d) | Elongation (%) | Thermal Shrinkage (%) | LASE-5% (g/d) | Permanent Strain (%) |
|---|---|---|---|---|---|---|
| A | 7.98 | 124 | 8.3 | 11.5 | 4.86 | — |
| B | 9.50 | 146 | 6.3 | 3.8 | 7.28 | 0 |
| C | 8.80 | 129 | 8.9 | 13.8 | 5.00 | — |
| D | 10.3 | 128 | 9.1 | 3.8 | 5.10 | 6.2 |
| E | 9.50 | 96 | 16.6 | 13.7 | 3.08 | 27.6 |
| F | 7.40 | 88 | 16.5 | 5.9 | 3.79 | 9.2 |

*See Table 3 for sample identity

That which is claimed is:

1. A drawn thermoplastic polyester filament having at least 9% taut-tie molecules and a thermal shrinkage of about 10% or less.

2. A thermoplastic polyester filament according to claim 1, wherein said filament is formed of a polyester.

3. A thermoplastic polyester filament according to claim 1, wherein said filament has a LASE-5% value of about 4 grams per denier or greater.

4. A thermoplastic polyester filament according to claim 1, said filament having a birefringence of about 0.2 or greater.

5. A thermoplastic polyester filament according to claim 1, said filament having a tenacity of about 9 grams per denier or greater.

6. A thermoplastic polyester filament according to claim 1, said filament having a modulus of about 100 grams per denier or greater.

7. A thermoplastic polymer filament according to claim 1, said filament having a LASE-5% value of about 4 grams per denier or greater.

8. A thermoplastic polymer filament according to claim 1, wherein said filament comprises polyester.

9. A thermoplastic polymer filament according to claim 1, said filament having a tenacity of about 9 grams per denier or greater.

10. A drawn thermoplastic polyester filament having at least 13.5% taut tie molecules and thermal shrinkage of about 10% or less.

* * * * *